US006068490A

United States Patent [19]

Salzberg

[11] Patent Number: 6,068,490

[45] Date of Patent: May 30, 2000

[54] ROTATABLE ELECTRICAL CONNECTOR ASSEMBLY

[76] Inventor: Max Salzberg, 6867 Baily Road, Côte St-Luc, Québec, Canada, H4V 1A5

[21] Appl. No.: 09/056,580

[22] Filed: Apr. 8, 1998

Related U.S. Application Data

[60] Provisional application No. 60/041,901, Apr. 14, 1997.

[51] Int. Cl.[7] ..... H01R 39/00

[52] U.S. Cl. ..... 439/25; 439/22; 439/23

[58] Field of Search ..... 439/20–25

[56] References Cited

U.S. PATENT DOCUMENTS

| | | | |
|---|---|---|---|
| 2,898,572 | 8/1959 | Shinn | 439/22 OR |
| 3,437,976 | 4/1969 | Nelson | 439/23 OR |
| 3,951,487 | 4/1976 | Waldbrook | 439/21 OR |
| 4,753,600 | 6/1988 | Williams | 439/22 OR |

*Primary Examiner*—Michael L. Gellner
*Assistant Examiner*—Daniel Wittels

[57] ABSTRACT

A rotatable electrical connector assembly provided with a fixed portion and a rotatable portion is described herein. The fixed portion includes an electrical plug provided at a first end thereof, an electrical socket provided at a second end thereof and an intermediate cylindrical portion provided between the electrical plug and the electrical socket. The cylindrical portion includes three protruding annular terminals connected to the electrical plug. The rotatable portion includes a cylindrical aperture to be mounted to the cylindrical portion for rotative movement. Three slip rings are so mounted to the rotatable portion as to be in contact with a respective annular terminal of the fixed portion to provide electrical contact between the rotatable portion and the fixed portion at any angular position of the rotatable portion with respect to the fixed portion. An electrical socket is electrically connected to the slip rings.

13 Claims, 3 Drawing Sheets

ROTATABLE ELECTRICAL CONNECTOR ASSEMBLY

This application claims benefit of Provisional Application No. 60/041,901 filed Apr. 14, 1997.

FIELD OF THE INVENTION

The present invention relates to electrical connectors. More specifically, the present invention relates to an electrical connector assembly provided with a rotatable portion.

BACKGROUND OF THE INVENTION

Rotatable electrical connector assemblies are known in the art. They usually include a fixed portion provided with an electrical plug to be inserted in an electrical wall socket and a rotatable portion so mounted to the fixed portion as to be rotatable about a rotation axis. The rotatable portion is usually provided with a multi-conductor electrical cable to which an electric appliance is connected. Electrical connection is maintained between the fixed and rotatable portions to allow electric current to flow from the electrical wall socket to the electric appliance at any given angle of the rotatable portion with respect to the fixed portion. Continuous rotation of the rotatable portion with respect to the fixed portion is therefore possible to prevent the electrical cable from becoming twisted during the use of the electrical appliance.

U.S. Pat. No. 3,437,976, issued to Russell A. NELSON on Apr. 8, 1969 and entitled: "Swiveling connector for electric cord" describes a cylindrical electrical connector assembly provided with the abovementioned features. Indeed, the electrical connection between the rotatable portion and the fixed portion is maintained by an assembly comprising a central cylindrical connector, similar to a headphone jack, axially mounted to the fixed portion and a pair of blades so mounted to the rotatable portion as to be in contact with a respective portion of the cylindrical connector. The blades defining plug receiving terminals of an electrical socket. The cylindrical configuration of the central connector enables the continuous electrical contact between the rotatable portion and the fixed portion by providing a smooth cylindrical contact surface for the blades.

The connector assembly described by NELSON has the drawback that the interconnection of the rotational portion to the fixed portion is such that the electrical plug of the fixed portion and the electrical socket of the rotatable portion must be at opposed longitudinal ends of the electrical connector to provide an adequate rotatable action. This is a significant drawback since it increases the length of the connector making it less versatile. On the other hand, if electrical connectors are made according to FIGS. 1 and 2 of the above noted United States Patent, the length of electrical cable provided between the electrical plug and the electrical connector will defy the purpose of the connector by becoming twisted. Furthermore, the installation of the electrical connector of NELSON in an electrical wall socket reduces the number of electrical wall sockets available.

SUMMARY OF THE INVENTION

An object of the present invention is therefore to provide an improved rotatable electrical connector assembly free of the above mentioned drawbacks of the prior art.

More specifically, in accordance with the present invention, there is provided a rotatable electrical connector assembly comprising:

a fixed portion including:

a longitudinal body having first and second ends;

an electrical plug provided at the first end of the longitudinal body; the electrical plug including a predetermined number of prongs;

a first electrical socket provided at the second end of the longitudinal body; the first electrical socket including a predetermined number of first prong receiving terminals;

a generally cylindrical portion provided between the electrical plug and the electrical socket; the cylindrical portion including a predetermined number of annular terminals; the prongs, first prongs receiving terminals and annular terminals being electrically connected via a predetermined number of electrical conductors;

a rotatable portion including:

a longitudinal body having a generally cylindrical aperture configured and sized to be coaxially mounted to the generally cylindrical portion of the fixed portion for rotational movement;

a predetermined number of slip rings so mounted to the longitudinal body as to be in electrical contact with a respective annular terminal of the fixed portion when the rotatable portion is rotatably mounted to the fixed portion;

a second electrical socket having a predetermined number of second prong receiving terminals, each electrically connected to a respective slip ring.

According to another aspect of the present invention, there is provided a rotatable electrical connector assembly comprising:

a fixed portion including:

a longitudinal body having first and second ends;

an electrical plug provided at the first end of the longitudinal body; the electrical plug including a predetermined number of prongs;

an electrical socket provided at the second end of the longitudinal body; the electrical socket including a predetermined number of prong receiving terminals;

a generally cylindrical portion provided between the electrical plug and the electrical socket; the cylindrical portion including a predetermined number of annular terminals; the prongs, prongs receiving terminals and annular terminals being electrically connected via a predetermined number of electrical conductors;

a rotatable portion including:

a longitudinal body having a generally cylindrical aperture configured and sized to be coaxially mounted to the generally cylindrical portion of the fixed portion for rotational movement;

a predetermined number of slip rings so mounted to the longitudinal body as to be in electrical contact with a respective annular terminal of the fixed portion when the rotatable portion is rotatably mounted to the fixed portion; each the slip ring including an electrical conductor connecting means to receive an electrical conductor.

Other objects and advantages of the present invention will become more apparent to one skilled in the art upon reading of the following non restrictive description of a preferred embodiment thereof, given by way of example only with reference to the appended drawings.

DESCRIPTION OF THE PREFERRED EMBODIMENT

Figures 1, 2, 3:
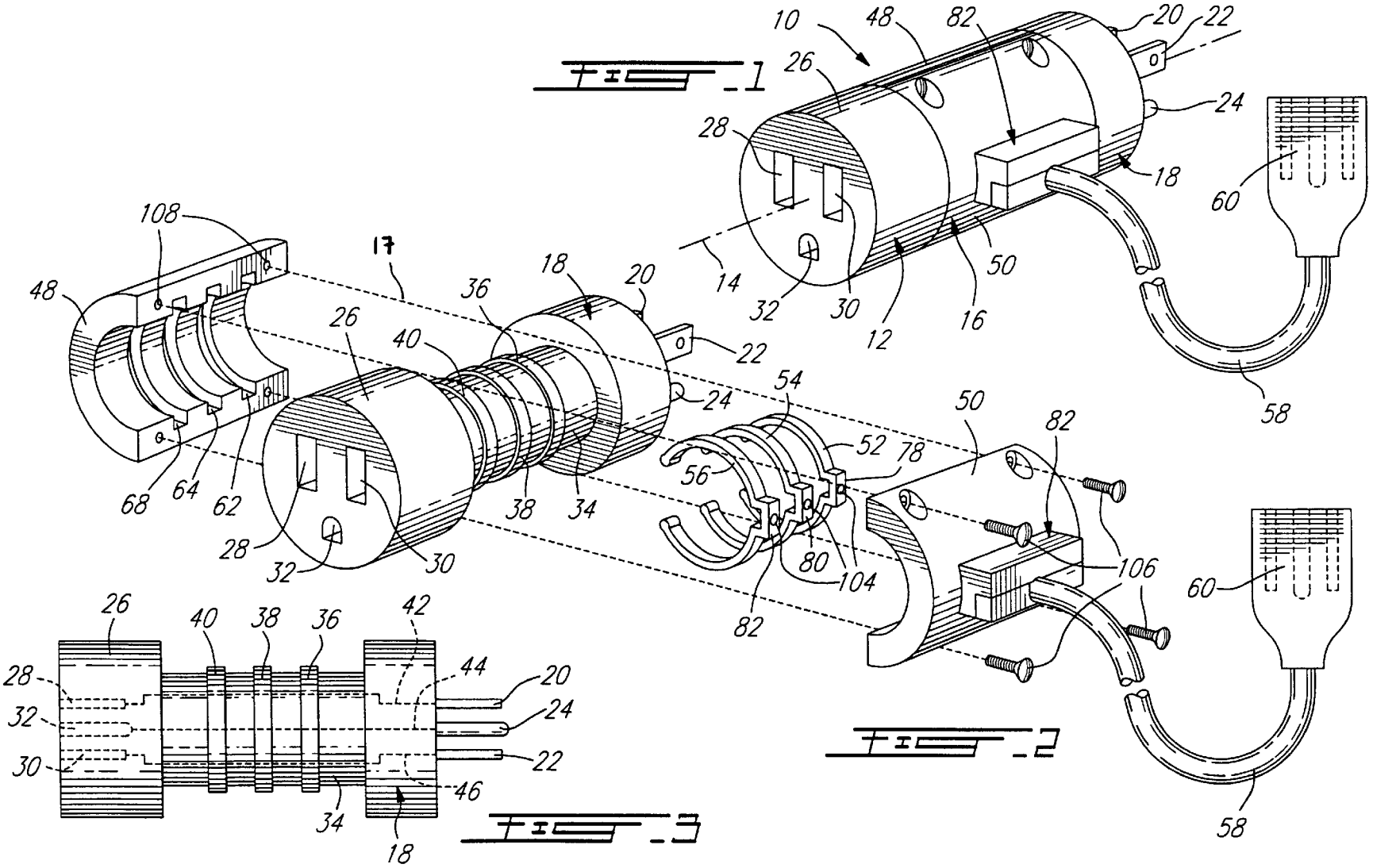
FIG. 1, in a perspective view, illustrates a rotatable electrical connector assembly according to a first embodiment of the present invention.
FIG. 2, in an exploded perspective view, illustrates the various elements of the connector assembly of FIG. 1.
FIG. 3, in a schematic top plan view, illustrates the electrical connections of the elements of the fixed portion of the connector assembly of FIG. 1.

Turning now to FIGS. 1 to 6 of the appended drawings, a rotatable electrical connector assembly 10 according to a first embodiment of the present invention will be described.

The rotatable connector assembly 10 includes a generally cylindrical fixed portion 12 having a longitudinal axis 14, and a rotatable portion 16, also generally cylindrical, removably and coaxially mounted to the fixed portion 12 so as to be rotatable about the longitudinal axis 14.

The fixed portion 12 has a longitudinal body 17 including an electrical plug 18, at a first end thereof, conventionally provided with a line prong 20, a neutral prong 22 and a ground prong 24. The fixed portion 12 also includes an electrical socket 26, at a second end of the longitudinal body 17. The electrical socket 26 is conventionally provided with a line prong receiving terminal 28, a neutral prong receiving terminal 30 and a ground prong receiving terminal 32.

The electrical plug 18 and the electrical socket 26 are joined via a generally cylindrical rotatable portion receiving connector 34 provided with an annular line terminal 36, an annular neutral terminal 38 and an annular ground terminal 40. As can be better seen from FIG. 2, the annular terminals 36, 38 and 40 protrude from the cylindrical body of the rotatable portion receiving connector 34.

Of course, prongs 20, 22 and 24, and terminals 28, 30, 32, 36, 38 and 40 are made of an electrically conductive material such as, for example, a suitable metallic alloy.

Turning briefly to FIG. 3 of the appended drawings, the fixed portion 12 also includes a first electrical conductor 42 electrically connecting the prong 20, the prong receiving terminal 28 and the annular terminal 36; a second electrical conductor 44 electrically connecting the prong 22, the prong receiving terminal 30 and the annular terminal 38; and a third electrical conductor 46 electrically connecting the prong 24, the prong receiving terminal 32 and the annular terminal 40. As can be better seen from FIG. 6, the electrical conductors 42, 44 and 46 are respectively connected to the annular rings 36, 38 and 40 via secondary electrical conductors 47.

Turning now to FIG. 2 of the appended drawings, the rotatable portion 16 includes first and second semi-cylindrical half-shells 48 and 50, forming the body of the rotatable portion 16, three slip rings 52, 54 and 56 and a multi-conductor electrical cable 58 provided with an electrical socket 60 at a distal end thereof.

The half-shell 48 is provided with three internal circumferential grooves 62, 64 and 68 configured and sized to snugly receive a respective slip ring 52, 54 or 56.

Figure 5:
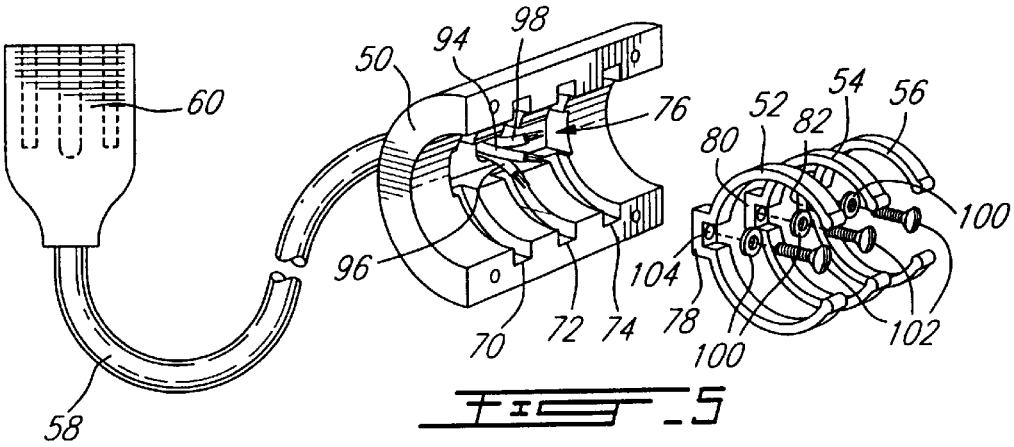
FIG. 5, in an exploded view, illustrates the inside of the half-shell of FIG. 4 and the connector rings of the rotatable portion.
Figure 6:
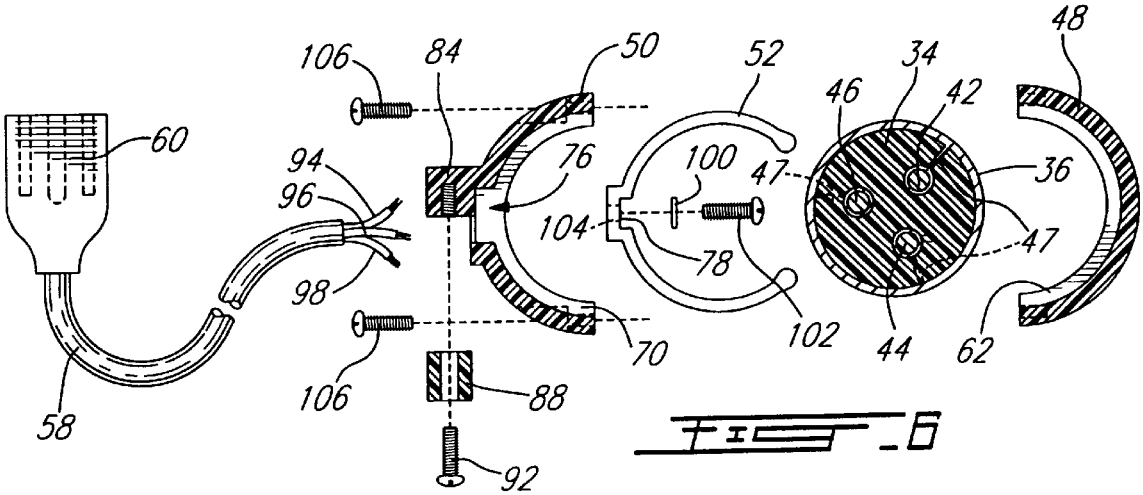
FIG. 6, in an exploded sectional view, illustrates the connector assembly of FIG. 1.

Similarly, as can be seen from FIG. 5, half-shell 50 is provided with three internal circumferential grooves 70, 72 and 74 configured and sized to snugly receive a respective slip ring 52, 54 or 56. The half-shell 50 also includes a rectangular groove 76 sized to receive the conductor retaining portions 78, 80 and 82 of the slip rings 52, 54 and 56.

Figure 4:
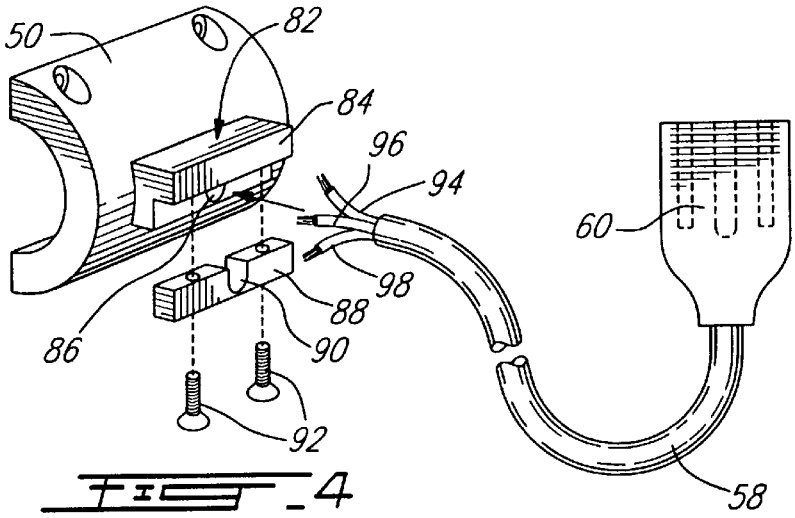
FIG. 4, in an exploded perspective view, illustrates a half-shell of the rotatable portion of the connector assembly of FIG. 1.

Turning now more specifically to FIG. 4 of the appended drawings, the half-shell 50 further includes an electrical cable retaining assembly 82 comprising a first portion 84 provided with an aperture 86 and fixedly mounted to the half-shell 50 and a second portion 88 provided with a cable receiving groove 90. The second portion 88 may be removably secured to the first portion 84 via fasteners 92 to mount the electrical cable 58 to the half shell 50. As can also be seen from FIG. 4, the multi-conductor electrical cable 58 includes three electrical conductors 94, 96 and 98 that may be removably connected to the conductor retaining portion of a respective slip ring 52, 54 or 56 via washers 100, fasteners 102 and threaded apertures 104 (see FIG. 5).

Returning to FIG. 2, the half-shells 48 and 50 are removably mounted to one another via fasteners 106 configured and sized to engage apertures 108 of the half-shell 48.

As will be readily understood by one skilled in the art, when each slip ring 52, 54 and 56 is engaged to a respective annular terminals 36, 38 and 40, and when the half-shells 48 and 50 are assembled via fasteners 106, the rotatable portion 16 may continuously rotate about the rotatable portion receiving connector 34 while the electrical contact is maintained between the fixed portion 12 and the rotatable portion 16. Indeed, rotation of the rotatable portion 16 about the longitudinal axis 14 is possible since the rotatable portion receiving connector 34 is generally cylindrical and since the body of the rotatable portion 16 define a cylindrical aperture coaxial with the receiving connector 34 when assembled.

It is to be noted that the engagement of the conductor retaining portions 78, 80 and 82 of the slip rings in the rectangular groove 76 of the half-shell 50 force the rotation of the slip rings upon rotation of the rotatable portion 16.

It is also to be noted that the internal grooves of the half-shells 48 and 50 safely retain the slip rings 52, 54 and 56 in contact with the annular terminals 36, 38 and 40 and prevent short circuits between the slip rings. Of course, electrically conductive lubricating compound, such as electrically conductive grease, could be provided between the slip rings and the annular terminals to prevent premature wear of these metallic elements and to increase the electrical contact between the slip rings and the annular terminals.

As will be easily understood by one skilled in the art, the electrical socket 60 could be omitted if the multi-conductor electrical cable 58 is intended to replace the conventional electrical cable of an electrical appliance. If this is the case, the distal end (not shown) of the electrical connectors of the electrical cable 58 are simply connected to the terminals of the electrical appliance in a conventional manner. This use of the rotatable electrical connector assembly 10 is particularly advantageous with manual power tools, such as electric drills, or when an appliance must be plugged without decreasing the number of wall sockets available.

Figure 7:
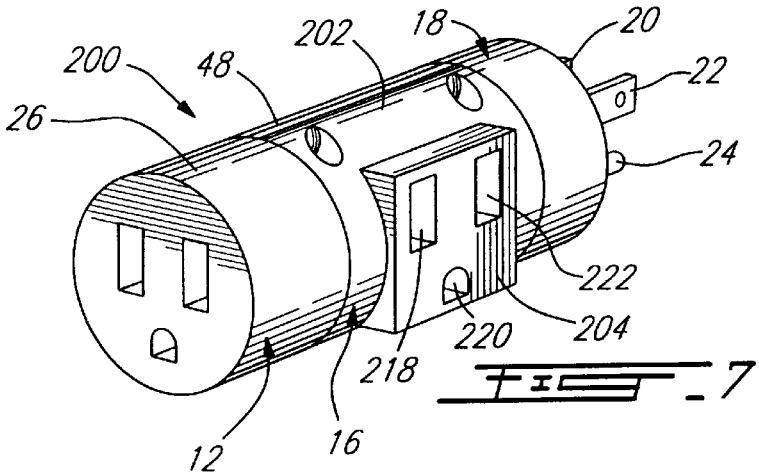
FIG. 7, in a perspective view, illustrates a rotatable electrical connector assembly according to a second embodiment of the present invention.
Figure 8:
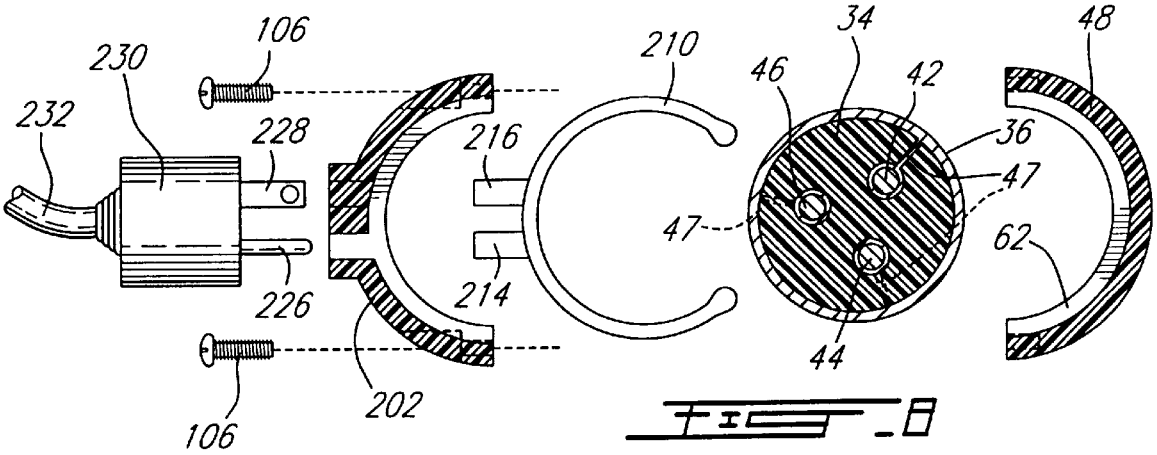
FIG. 8, in an exploded sectional view, illustrates the connector assembly of FIG. 7.
Figure 9:
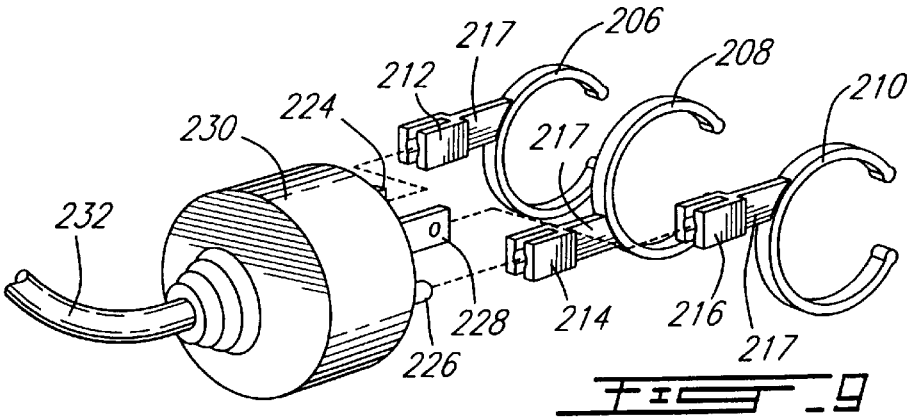
FIG. 9, in an exploded view, illustrates the electrical connection between the three prongs of an electrical plug and the slip rings of the rotatable electrical connector assembly of FIG. 7.

Turning now to FIGS. 7 to 9 of the appended drawings, a rotatable electrical connector assembly 200 according to a second embodiment of the present invention will be described.

For concision purposes, and since the connector assembly 10 of FIGS. 1–6 and the connector assembly 200 of FIGS. 7–9 are very similar, only the major differences between these two electrical connectors will be described hereinafter. The same numeral numbers will identify the same elements.

One major difference between the electrical connector 200 and the electrical conductor 10 resides in the half-shells of the rotatable assembly 16.

The rotatable portion 16 of the electrical connector 200 includes a first half shell 48 and a second half shell 202. The half-shell 202 includes an integral electrical socket 204. The rotatable portion 16 also includes three slip rings 206, 208 and 210, electrically connected to a respective prong receiving terminal 212, 214 and 216 via rigid electrical conductors 217.

The prong receiving terminals 212, 214 and 216 are positioned to face respective apertures 218, 220 and 222 of the electrical socket 204 when the rotatable portion 16 is mounted to the fixed portion 12.

The prongs 224, 226 and 228 of an electrical plug 230 may therefore be electrically connected to the slip rings 206, 208 and 210, respectively, to electrically connect the conductors (not shown) of a multi-conductor electrical cable 232 to the prongs 20, 22 and 24 of the electrical plug 18.

Of course, the rectangular groove 76 of the half-shell 50 is not required in the half-shell 202.

The rotatable electrical connector assembly of the present invention has many advantages. As a non-limiting example, the insertion of the electrical plug 18 in an electrical wall socket (not shown) does not decrease the number of sockets available since the electrical socket 26 may be used.

It is to be noted that even though electrical plugs and sockets including a ground line are illustrated in the appended drawings and described in the above description, the rotatable electrical connector assembly of the present invention is not restricted in any way to such plugs and sockets. It is also to be noted that the configuration of the prongs and prong receiving terminals are shown for illustrative purposes only and could be modified at will without departing from the subject invention.

Although the present invention has been described hereinabove by way of a preferred embodiment thereof, this preferred embodiment can be modified at will, without departing from the spirit and nature of the subject invention as defined in the appended claims.

What is claimed is:

1. A rotatable electrical connector assembly comprising:

a fixed portion including:

a longitudinal body having first and second ends;

an electrical plug provided at said first end of said longitudinal body; said electrical plug including a predetermined number of prongs;

a first electrical socket provided at said second end of said longitudinal body; said first electrical socket including a predetermined number of first prong receiving terminals;

a generally cylindrical portion provided between said electrical plug and said electrical socket; said cylindrical portion including a predetermined number of annular terminals; said prongs, first prongs receiving terminals and annular terminals being electrically connected via a predetermined number of electrical conductors;

a rotatable portion including:

a longitudinal body having a generally cylindrical aperture configured and sized to be coaxially mounted to said generally cylindrical portion of said fixed portion for rotational movement;

a predetermined number of slip rings so mounted to said longitudinal body as to be in electrical contact with a respective annular terminal of said fixed portion when said rotatable portion is rotatably mounted to said fixed portion;

a second electrical socket having a predetermined number of second prong receiving terminals, each electrically connected to a respective slip ring.

2. A rotatable electrical connector assembly as defined in claim 1, wherein said second electrical socket is integrally mounted to said body of said rotatable portion.

3. A rotatable electrical connector assembly as defined in claim 2, wherein each said second prong receiving terminal is electrically connected to a respective slip ring via a rigid electrical conductor.

4. A rotatable electrical connector assembly as defined in claim 1, wherein said second electrical socket is connected to said body of said rotatable portion via a multi-conductor electrical cable.

5. A rotatable electrical connector assembly as defined in claim 4, wherein each of said predetermined number of second prong receiving terminals is electrically connected to a respective slip ring via an electrical conductor of said multi-conductor electrical cable.

6. A rotatable electrical connector assembly as defined in claim 1, wherein each of said predetermined number of annular terminals protrudes from said generally cylindrical portion, and wherein each of said predetermined number of slip rings is provided in an internal circumferential groove of said longitudinal body of said rotatable portion.

7. A rotatable electrical connector assembly as defined in claim 1, wherein said longitudinal body of said fixed portion is generally cylindrical.

8. A rotatable electrical connector assembly as defined in claim 1, wherein said predetermined number is three.

9. A rotatable electrical connector assembly comprising:

a fixed portion including:

a longitudinal body having first and second ends;

an electrical plug provided at said first end of said longitudinal body; said electrical plug including a predetermined number of prongs;

an electrical socket provided at said second end of said longitudinal body; said electrical socket including a predetermined number of prong receiving terminals;

a generally cylindrical portion provided between said electrical plug and said electrical socket; said cylindrical portion including a predetermined number of annular terminals; said prongs, prongs receiving terminals and annular terminals being electrically connected via a predetermined number of electrical conductors;

a rotatable portion including:

a longitudinal body having a generally cylindrical aperture configured and sized to be coaxially mounted to said generally cylindrical portion of said fixed portion for rotational movement;

a predetermined number of slip rings so mounted to said longitudinal body as to be in electrical contact with a respective annular terminal of said fixed portion when said rotatable portion is rotatably mounted to said fixed portion;

each said slip ring including an electrical conductor connecting means to receive an electrical conductor.

10. A rotatable electrical connector assembly as defined in claim 9, further comprising a multi-conductor electrical cable having a predetermined number of electrical conductors, a first end of each electrical conductor being electrically connected to said electrical conductor connecting means of a respective slip ring and a second end of each electrical conductor being electrically connectable to an electrical appliance.

11. A rotatable electrical connector assembly as defined in claim 9, wherein each of said predetermined number of annular terminals protrudes from said generally cylindrical portion, and wherein each of said predetermined number of slip rings is provided in an internal circumferential groove of said longitudinal body of said rotatable portion.

12. A rotatable electrical connector assembly as defined in claim 9, wherein said longitudinal body of said fixed portion is generally cylindrical.

13. A rotatable electrical connector assembly as defined in claim 9, wherein said predetermined number is three.

* * * * *